US007334872B2

(12) United States Patent
Kobayashi et al.

(10) Patent No.: US 7,334,872 B2
(45) Date of Patent: Feb. 26, 2008

(54) NOZZLE PLATE OF INKJET HEAD AND METHOD FOR PRODUCING THE SAME

(75) Inventors: Yasunori Kobayashi, Gifu (JP); Atsushi Ito, Owariasahi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 84 days.

(21) Appl. No.: 10/874,218

(22) Filed: Jun. 24, 2004

(65) Prior Publication Data

US 2004/0263565 A1 Dec. 30, 2004

(30) Foreign Application Priority Data

Jun. 30, 2003 (JP) ..... 2003-188996

(51) Int. Cl.
*B41J 2/14* (2006.01)
*B41J 2/165* (2006.01)

(52) U.S. Cl. ..... 347/47; 347/45

(58) Field of Classification Search ..... 347/44, 347/45, 47

See application file for complete search history.

(56) References Cited

U.S. PATENT DOCUMENTS 5,905,515 A * 5/1999 Yoshimura ..... 347/45
6,286,933 B1 * 9/2001 Murakami et al. ..... 347/47
6,511,156 B1 * 1/2003 Kazama et al. ..... 347/47

FOREIGN PATENT DOCUMENTS

JP A 9-193401 7/1997
JP A 10-264400 10/1998

* cited by examiner

*Primary Examiner*—An H. Do
(74) *Attorney, Agent, or Firm*—Oliff & Berridge, PLC

(57) ABSTRACT

There is provided a method for producing a nozzle plate of an inkjet head having a plurality of nozzles for ejecting ink. The method includes: preparing a nozzle plate base which has an electrical conductivity, the nozzle plate base including a nozzle plate, an outer frame surrounding the nozzle plate, and a plurality of connecting portions which connect the nozzle plate to the outer frame; forming the plurality of nozzles through the nozzle plate; dipping the nozzle plate base into an electrolytic solution; and energizing the outer frame of the nozzle plate base to plate the nozzle plate with a water repellent film. In this method, a gap formed between the nozzle plate and the outer frame is smaller than or equal to 10 mm.

19 Claims, 10 Drawing Sheets

NOZZLE PLATE OF INKJET HEAD AND METHOD FOR PRODUCING THE SAME

BACKGROUND OF THE INVENTION

The present invention relates to a nozzle plate of an inkjet head and a producing method thereof, and more particularly to water repellent finishing of the nozzle plate.

In general, the inkjet head provided in printing devices such as a printer and a facsimile machine has the nozzle plate on which a plurality of nozzles for ejecting ink are arranged. In the inkjet head, the nozzles respectively communicate with pressure chambers, to which actuators such as a piezoelectric element are respectively attached.

By operating the actuator, a certain amount of ink pressurized in the pressure chamber is introduced to the nozzle, and then is ejected from the nozzle.

If the ink residues remain around an ejecting side of the nozzle, variations in an ejecting direction of the ink and/or in an ejecting amount of the ink may occur, which deteriorates accuracy of ejecting operation of the ink. For this reason, an ejecting side surface of the nozzle plate (hereafter, referred to as an ejecting surface) is typically covered with a water repellent film.

Japanese Patent Provisional Publication No. HEI 9-193401 discloses a nozzle plate covered with a water repellent film. In this publication, it is disclosed that the water repellent film, which is made of a resin containing fluorine, is formed on the nozzle plate by electroplating.

FIG. 1 is a plan view of a nozzle plate 101 and an electrode 103 which are to be subjected to an electroplating process. As shown in FIG. 1, the nozzle plate 101 has a rectangular form. For the electroplating process, the nozzle plate 101 is attached to the electrode 103 having an aperture 103*a*. On the ejecting surface of the nozzle plate 101, a plurality of nozzle groups 102, each of which has a plurality nozzles arranged in a matrix, have been formed and arranged in parallel with a longer side of the rectangular form of the nozzle plate 101.

As shown in FIG. 1, each nozzle group 102 is located in the proximity of one of the longer sides of the nozzle plate 101. For this reason, the nozzle plate 101 is required to be electrically connected to the electrode 103 through shorter sides 101*a* thereof. By dipping the nozzle plate 101 and the electrode 103 into an electrolytic solution, and then applying a voltage to the electrode 103, the electroplating process is performed. Consequently, the water repellent film is formed on the ejecting surface of the nozzle plate 101.

SUMMARY OF THE INVENTION

However, according to the above mentioned conventional electroplating process, a potential in each of the vicinities of the shorter sides 101*a* becomes higher than a potential in a central portion of the nozzle plate 101 due to resistance of the nozzle plate 101. Therefore, a potential difference is caused between the central portion of the nozzle plate 101 and the vicinities of the shorter sides 101*a*.

If such a potential difference is caused, a difference in thickness of plating occurs between the central portion of the nozzle plate 101 and the peripheries of the shorter sides 101*a* of the nozzle plate 101. The water repellent film is formed by the electroplating process such that the water repellent film overhangs an orifice of the nozzle.

Accordingly, if the potential difference is caused between the central portion of the nozzle plate 101 and the vicinities of the shorter sides 101*a*, the amount of the overhanging portion of the water repellent film varies among the nozzles on the nozzle plate 101, which deteriorates the accuracy of ejecting operation of the ink.

The present invention is advantageous in that it provides a nozzle plate configured such that variations in diameters of nozzles are decreased, and provides a producing method of such a nozzle plate.

According to an aspect of the invention, there is provided a method for producing a nozzle plate of an inkjet head having a plurality of nozzles for ejecting ink. The method includes: preparing a nozzle plate base which has an electrical conductivity, the nozzle plate base including a nozzle plate, an outer frame surrounding the nozzle plate, and a plurality of connecting portions which connect the nozzle plate to the outer frame; forming the plurality of nozzles through the nozzle plate; dipping the nozzle plate base into an electrolytic solution; and energizing the outer frame of the nozzle plate base to plate the nozzle plate with a water repellent film. In this method, a gap formed between the nozzle plate and the outer frame is smaller than or equal to 10 mm.

Since in the above mentioned method the gap is smaller or equal to 10 mm, it becomes possible to uniform a current flowing through the nozzle plate. Consequently, uniformity of the thickness of the water repellent film formed on the nozzle plate is enhanced.

Optionally, the method may include the step of removing the nozzle plate from the nozzle plate base by cutting the plurality of connecting portions after the step of energizing is finished.

In a particular case, the nozzle plate may have a rectangular form, and the plurality of connecting portions may be arranged along both of longitudinal sides of the rectangular form of the nozzle plate.

Optionally, the plurality of connecting portions may be arranged such that each of the connecting portions arranged one of the longitudinal sides of the nozzle plate is not opposed to each of the connecting portions arranged along the other longitudinal side of the nozzle plate.

In a particular case, the nozzle plate may have a rectangular form, and the nozzle plate may have a plurality of nozzle groups, each of which has a plurality of nozzles arranged in a matrix. The plurality of nozzle groups are arranged in parallel with a longitudinal side of the rectangular form of the nozzle plate at predetermined intervals. Further, adjacent ones of the plurality of nozzle groups are shifted, in directions opposite to each other, by the same distance with respect to a center line of a shorter side of the nozzle plate, and the plurality of connecting portions are arranged along both of longitudinal sides of the nozzle plate, each of the connecting portions arranged one of the longitudinal sides of the nozzle plate is opposed to each of the nozzle groups shifted to the other of the longitudinal sides of the nozzle plate with respect to the center line of the shorter side of the nozzle plate.

Optionally, a distance between adjacent ones of the connecting portions arranged along one of the longitudinal sides of the nozzle plate may be twice as long as the predetermined interval of the plurality of nozzle groups. Each of the connecting portions is located on a center line of a corresponding one of the nozzle groups located oppositely thereto, the center line passing through a center of the corresponding one of the nozzle groups in the longitudinal direction, the center line being parallel with the shorter side of the nozzle plate.

Still optionally, the plurality of connecting portion may include a first additional connecting portion and a second additional connecting portion. Further, when one of the shorter sides of the nozzle plate is defined as a first shorter side, and the other of the shorter sides of the nozzle plate is defined as a second shorter side, the first additional connecting portion may be located at a position shifted to the first shorter side by one predetermined interval of the plurality of nozzle groups from one of the nozzle groups located nearest to the first shorter side, the first additional connecting portion being located on the same longitudinal side as that to which the one of the nozzle groups located nearest to the first shorter side is shifted with respect to the center line of the shorter side. Further, the second additional connecting portion may be located at a position shifted to the second shorter side by one predetermined interval of the plurality of nozzle groups from one of the nozzle groups located nearest to the second shorter side, the second additional connecting portion being located on the same longitudinal side as that to which the one of the nozzle groups located nearest to the second shorter side is shifted with respect to the center line of the shorter side.

In a particular case, the nozzle plate base including the outer frame, the nozzle plate and the plurality of connecting portions may have a single-piece structure and may be made of a single material.

Optionally, before the step of the dipping, the nozzle plate base may be attached to an electrode used to energize the nozzle plate base, the electrode contacting a peripheral portion of the outer frame on a side on which the nozzle plate is to be covered with the water repellent film, the electrode having an electrical conductivity higher than that of the nozzle plate base.

Still optionally, the method may include the steps of: coating the nozzle plate with a resist so that the plurality of nozzles are filled with the resist before the step of the dipping; and removing the resist from the plurality of nozzles after the step of the plating.

According to another aspect of the invention, there is provided a nozzle plate having a rectangular form used for an inkjet head. The nozzle plate is provided with a plurality of nozzle groups arranged in parallel with a longitudinal side of the nozzle plate at predetermined intervals, each of the nozzle groups having a plurality of nozzles arranged in a matrix, and a plurality of connecting portions through which voltage is applied to the nozzle plate when the nozzle plate is subjected to plating of a water repellent film. In this structure, the plurality of connecting portions are arranged along both of longitudinal sides of the nozzle plate. Each of the connecting portions arranged one of the longitudinal sides of the nozzle plate is not opposed to each of the connecting portions arranged along the other longitudinal side of the nozzle plate.

With this configuration, it becomes possible to uniform a distribution of a current flow flowing through the nozzle plate. Consequently, uniformity of the thickness of the water repellent film formed on the nozzle plate is enhanced.

In a particular case, a distance between adjacent ones of the connecting portions arranged along one of the longitudinal sides of the nozzle plate may be twice as long as the predetermined interval of the plurality of nozzle groups.

Optionally, each of the connecting portions may be located on a center line of a corresponding one of the nozzle groups located oppositely thereto. The center line passes through a center of the corresponding one of the nozzle groups in the longitudinal direction. The center line is parallel with the shorter side of the nozzle plate.

Still optionally, the plurality of connecting portion may include a first additional connecting portion and a second additional connecting portion. Further, when one of the shorter sides of the nozzle plate is defined as a first shorter side, and the other of the shorter sides of the nozzle plate is defined as a second shorter side, the first additional connecting portion may be located at a position shifted to the first shorter side by one predetermined interval of the plurality of nozzle groups from one of the nozzle groups located nearest to the first shorter side, the first additional connecting portion being located on the same longitudinal side as that to which the one of the nozzle groups located nearest to the first shorter side is shifted with respect to the center line of the shorter side. Further, the second additional connecting portion may be located at a position shifted to the second shorter side by one predetermined interval of the plurality of nozzle groups from one of the nozzle groups located nearest to the second shorter side, the second additional connecting portion being located on the same longitudinal side as that to which the one of the nozzle groups located nearest to the second shorter side is shifted with respect to the center line of the shorter side.

In a particular case, adjacent ones of the plurality of nozzle groups may be shifted, in directions opposite to each other, by the same distance with respect to a center line of a shorter side of the nozzle plate. Further, the plurality of connecting portions are arranged along both of longitudinal sides of the nozzle plate, each of the connecting portions arranged one of the longitudinal sides of the nozzle plate being opposed to each of the nozzle groups shifted to the other of the longitudinal sides of the nozzle plate with respect to the center line of the shorter side of the nozzle plate.

Optionally, each of the plurality of nozzle groups may have a trapezoidal form, and a distance between a long side of the trapezoidal form of each nozzle group and the longitudinal side to which the each nozzle group is shifted is shorter than a distance between a short side of the trapezoidal form of the each nozzle group and the longitudinal side to which the each nozzle group is shifted.

According to another aspect of the invention, there is provided a nozzle plate base to be subjected to plating process. The nozzle plate base is provided with an outer frame, a nozzle plate, and a plurality of connecting portions which electrically connects the nozzle plate to the outer frame. Further, the nozzle plate includes a plurality of nozzle groups arranged in parallel with a longitudinal side of the nozzle plate at predetermined intervals, each of the nozzle groups having a plurality of nozzles arranged in a matrix. In this structure, the plurality of connecting portions are arranged along both of longitudinal sides of the nozzle plate, each of the connecting portions arranged one of the longitudinal sides of the nozzle plate is not opposed to each of the connecting portions arranged along the other longitudinal side of the nozzle plate.

With this configuration, it becomes possible to uniform a distribution of a current flow flowing through the nozzle plate. Consequently, uniformity of the thickness of the water repellent film formed on the nozzle plate is enhanced.

Optionally, the nozzle plate base may have a single-piece structure and may be made of a single material.

Still optionally, a gap smaller than or equal to 10 mm may be formed between the nozzle plate and the outer frame.

BRIEF DESCRIPTION OF THE ACCOMPANYING DRAWINGS

DETAILED DESCRIPTION OF THE EMBODIMENTS

Figure 1:
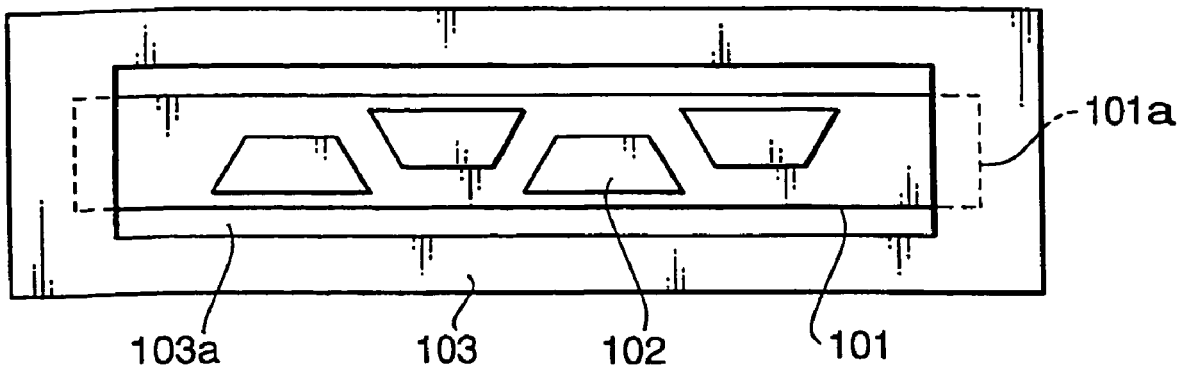
FIG. 1 PRIOR ART
FIG. 1 is a plan view of a conventional configuration of a nozzle plate and an electrode.
Figure 2:
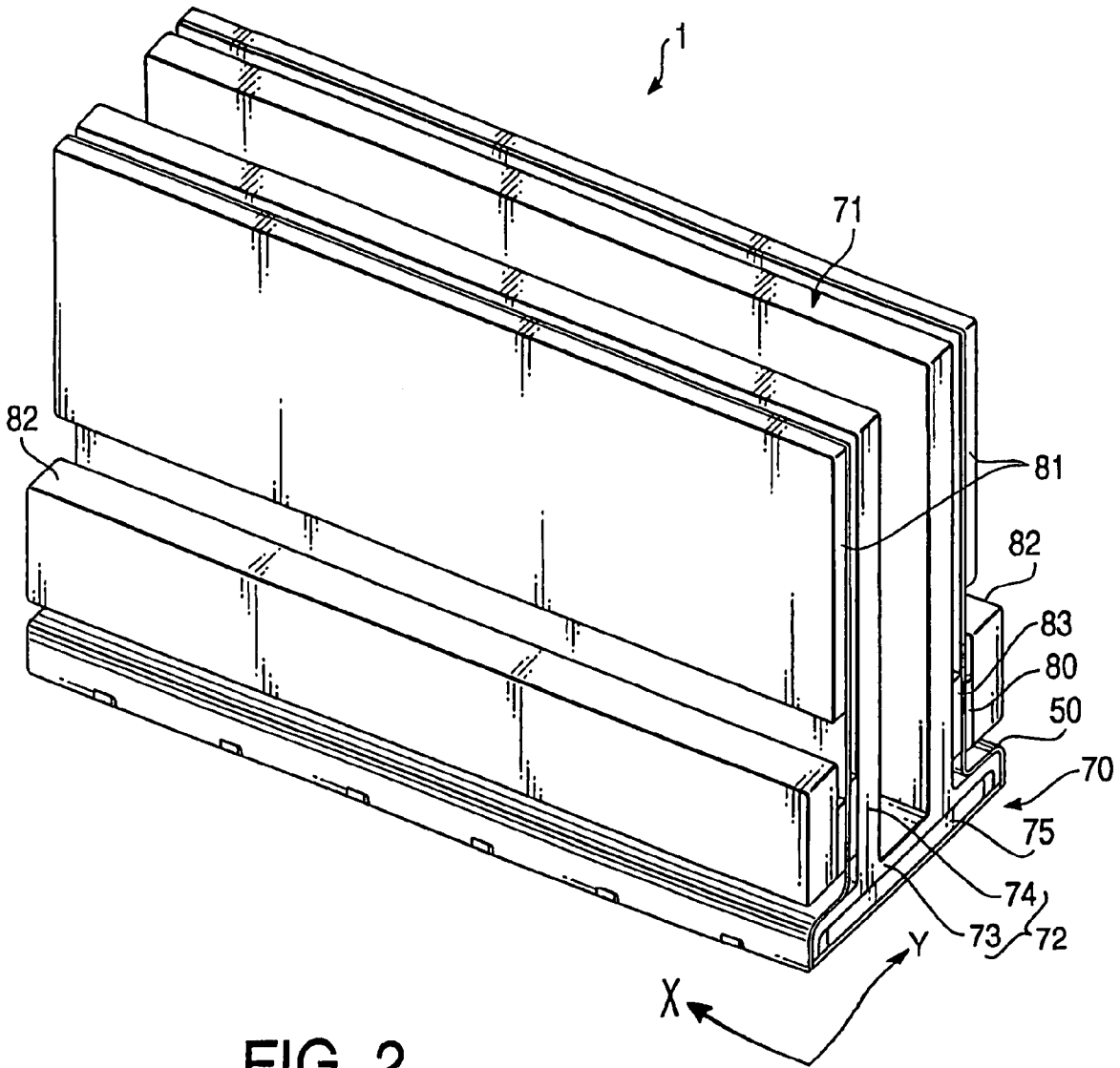
FIG. 2 is a perspective view of an inkjet head according to an embodiment of the invention.

FIG. 2 is a perspective view of an inkjet head 1 according to an embodiment of the invention. As shown in FIG. 2, the inkjet head 1 has a head unit 70 facing a sheet of paper. The head unit 70 is supported by a base 71. The inkjet head 1 is used in a printing device, such as a printer, such that the inkjet head 1 is moved in a X direction (i.e., a main scanning direction) while the sheet of paper is moved in a Y direction (i.e., an auxiliary scanning direction) to form a two dimensional image on the sheet of paper.

As described in detail below, the head unit 70 includes an ink flow channel unit 2, in which ink flow channels each having a pressure chamber 10 and a nozzle 8 are formed, and an actuator unit 4 which applies pressure to ink in the pressure chamber 10 (see FIGS. 3 and 5).

As shown in FIG. 2, the base 71 has a base block 75 and a holder 72. The base block 75 is cemented to a back side of the base unit 70 to hold the base unit 70. The holder 72 has a body unit 73, which holds the base block 75, and a supporting unit 74. The supporting unit 74 extends from the body unit 73 in a direction opposite to a head unit side. By use of the supporting unit 74, the inkjet head 1 is supported in the printing device.

On an outer region of the base 71, an FPC (flexible printed circuit) 50 is located via an elastic member 83. On the FPC 50, a driver IC (integrated circuit) 80 and a control board 81 which controls the driver IC 80 are mounted. A heatsink 82 is attached to the driver IC 80 for heat radiation of the driver IC 80.

Figure 3:
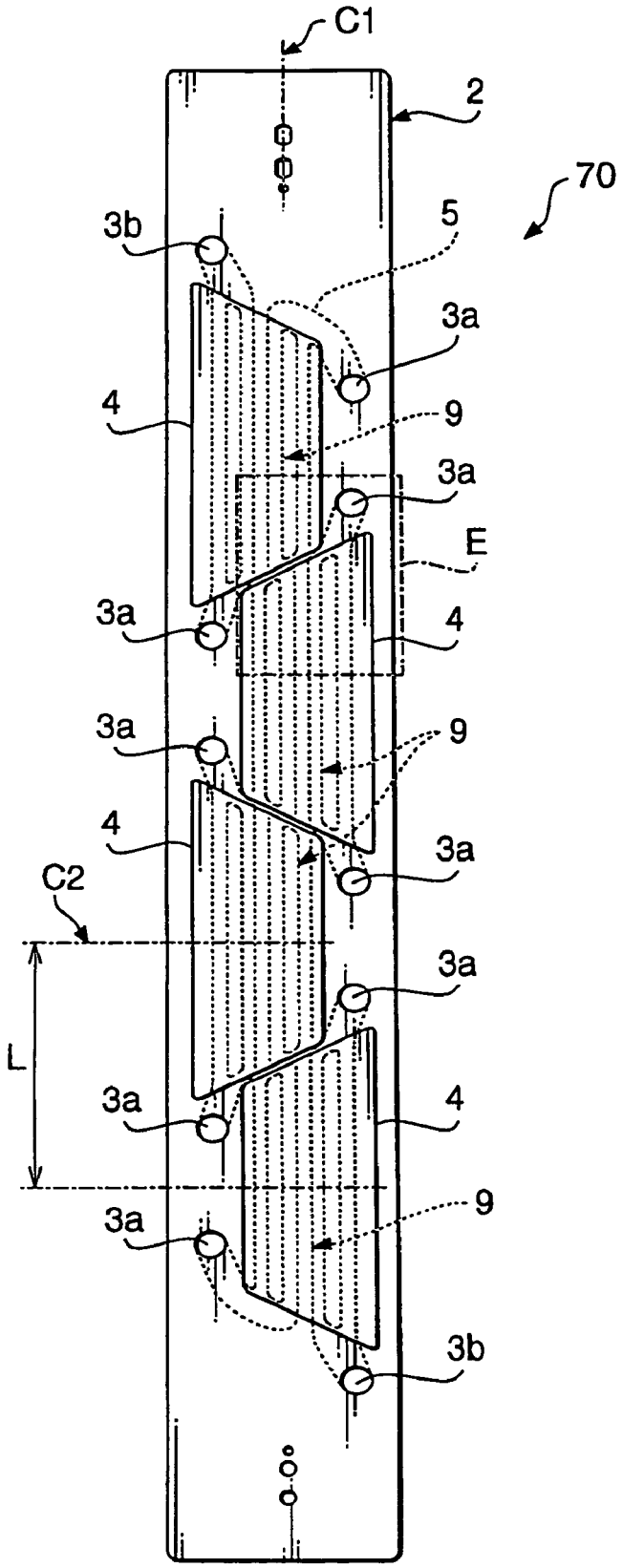
FIG. 3 is a plan view of a head unit of the inkjet head shown in FIG. 2.

FIG. 3 is a plan view of the head unit 70. As shown in FIG. 3, the ink flow channel unit 2 has a rectangular form and has a plurality of ejection element groups 9. Adjacent ones of the ejection element groups 9 are shifted, in directions opposite to each other, by the same distance with respect to a center line C1 of a shorter side of the ink flow channel 2. Each ejection element group 9 has a trapezoidal form.

To each ejection element group 9, the actuator unit 9 having an actuator is attached. The ejection element groups 9 are supplied with ink from manifolds 5 which communicate with ink reservoirs (not shown) via apertures 3*a* and 3*b*.

Figure 4:
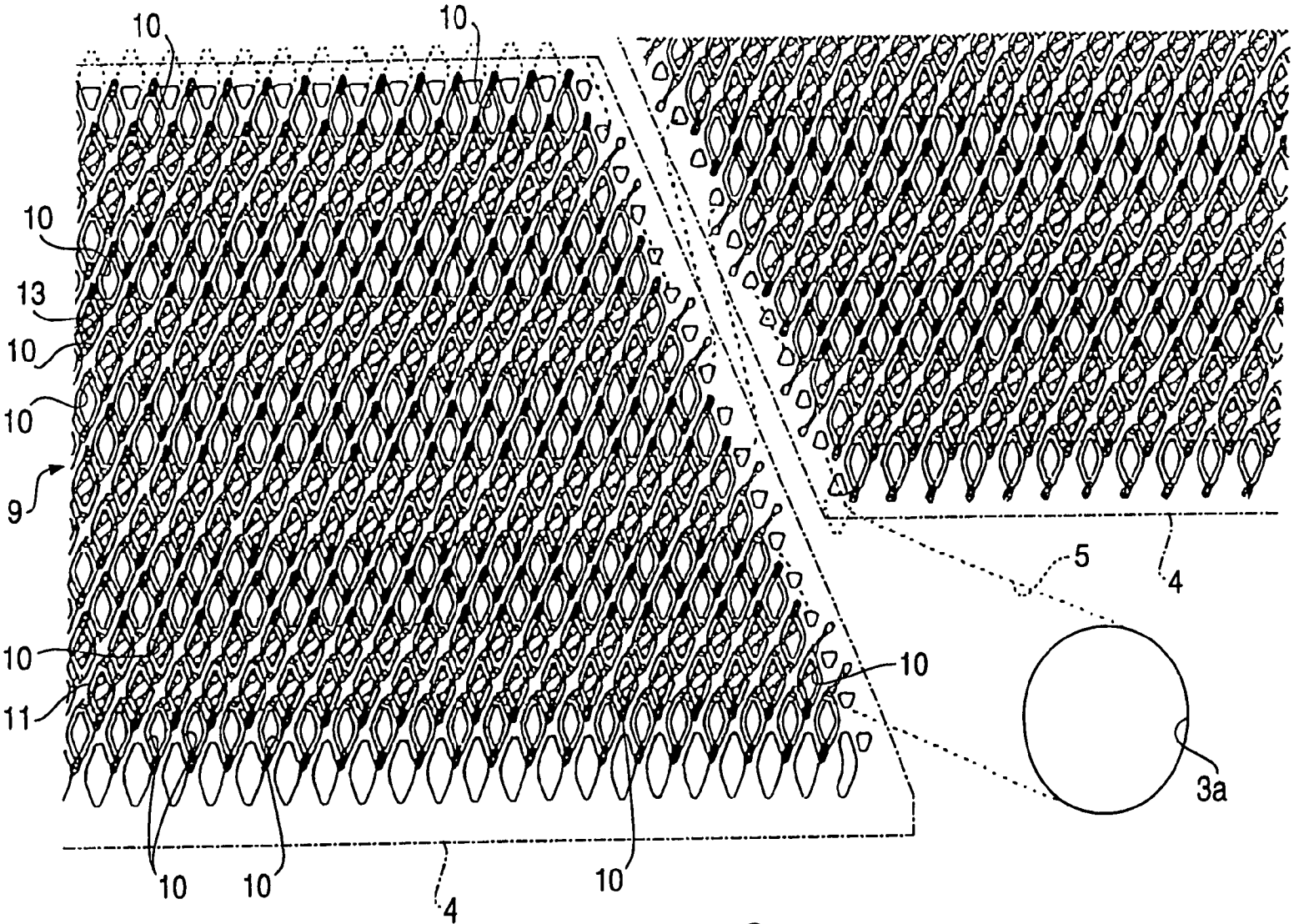
FIG. 4 is an enlarged view of a section of the head unit shown in FIG. 3.

FIG. 4 is an enlarged view of a section E shown in FIG. 3. As shown in FIG. 4, each ejection element group 9 is formed with a number of ejection elements 11 arranged in a matrix. The ejection elements 11 are driven to eject ink based on information of pixels of the image to be formed. Each ejection element 11 has an aperture 13 communicating with the manifold 5, the pressure chamber 10 and the nozzle 8 (see FIGS. 4 and 5).

Figure 5:
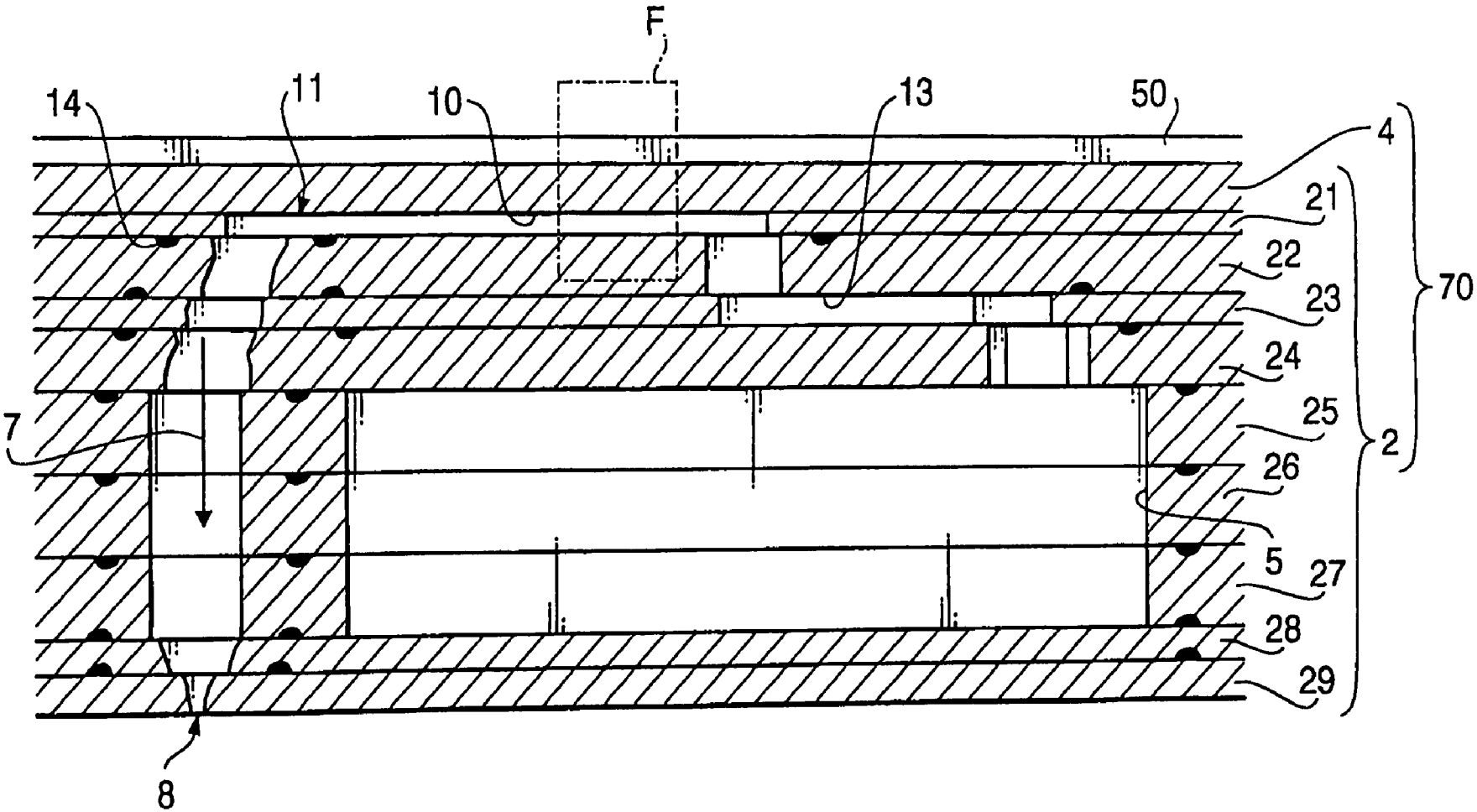
FIG. 5 is a sectional view of an ejection element of the inkjet head.

FIG. 5 is a sectional view of the ejection element 11. As shown in FIG. 5, the ink flow channel unit 2 has a laminated structure of a plurality of thin plate layers each made of, for example, Ni (nickel). More specifically, the ink flow channel unit 2 has, from an actuator side, a cavity plate 21, a base plate 22, an aperture plate 23, a supply plate 24, manifold plates 25, 26 and 27, a cover plate 28, and a nozzle plate 29.

The pressure chamber 10 is formed by the cavity plate 21. By the control of the actuator unit 4, the pressure chamber 10 sucks in the ink from the manifold 5 and applies pressure to the ink introduced therein to eject the ink from the nozzle 8. The aperture plate 23 is formed with the aperture 13 and an opening constituting a part of an outlet channel 7. The aperture 13 is used to decrease/increase flow of the ink flowing from the manifold 5 to the pressure chamber 10. The base plate 22 is formed with an opening through which the aperture 13 communicates with the pressure chamber 10, and an opening constituting a part of the outlet channel 7.

By a laminated structure of the manifold plates 25, 26 and 27, the manifold 5 and openings constituting a part of the outlet channel 7 are formed. The cover plate 28 is formed with openings constituting the outlet channel 7. The nozzle plate 29 is formed with openings constituting the nozzles 8 from which the ink flowing from the pressure chamber 10 is ejected.

By the above mentioned laminated structure, the ink flow channel is formed in the ink flow channel unit 2. Each thin plate layer has grooves 14 which trap redundant glue.

Figure 6:
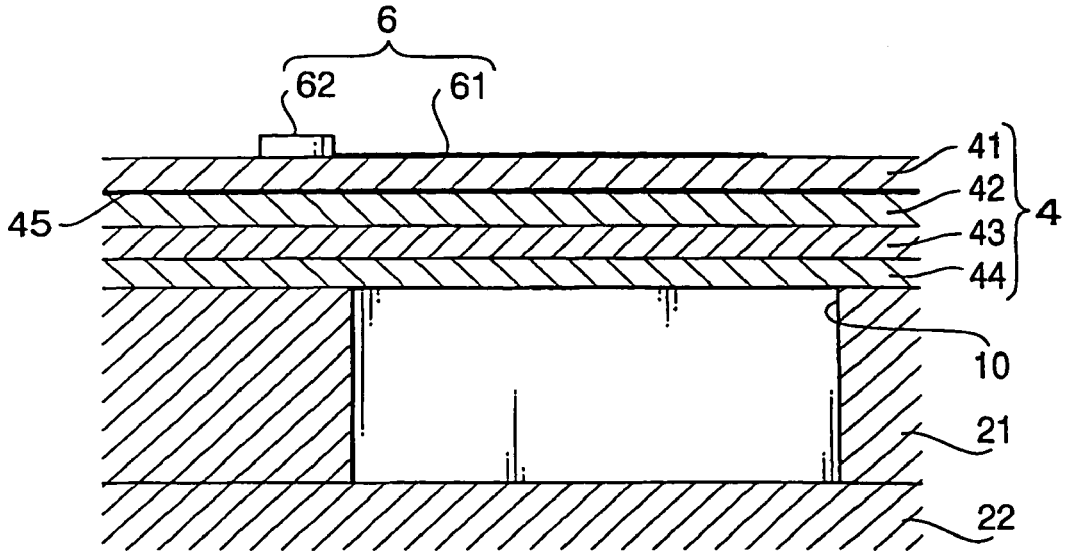
FIG. 6 is an enlarged view of a section of the ejection element shown in FIG. 5 illustrating a detailed structure of an actuator unit.

FIG. 6 is an enlarged view of a section F shown in FIG. 5 illustrating a detailed structure of the actuator unit 4. As shown in FIG. 6, the actuator unit 4 has a laminated structure of a plurality of piezoelectric sheets 41, 42, 43 and 44, and an internal electrode 45.

Figure 7:
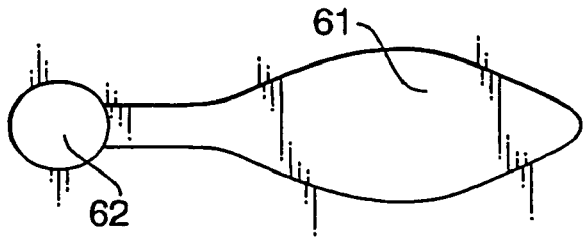
FIG. 7 is a plan view of an electrode unit of the actuator unit.

On a surface of the actuator unit 4 farthest from the ink flow channel unit 2, an electrode unit 6 is formed for each pressure chamber 10. FIG. 7 is a plan view of the electrode unit 6. As shown in FIG. 7, the electrode unit 6 has a land 62 and an electrode 61. The electrode 61 has a rhombic shape which is substantially the same as the shape of the pressure chamber when the electrode 61 and the pressure chamber 10 are viewed as plane views. Thus, the actuators respectively corresponding to ejection elements 11 are formed.

By applying a voltage to the electrode 61, the actuator undergoes a mechanical distortion, which changes the volumetric capacity of the pressure chamber 10. Consequently, the suction and emission of the ink can be attained.

Figure 8:
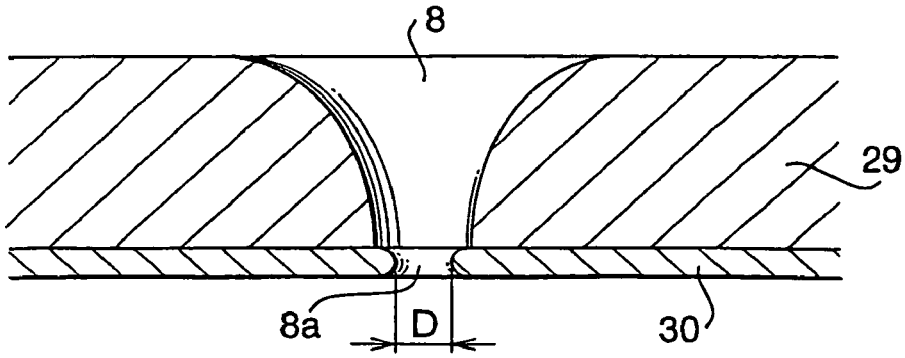
FIG. 8 is a sectional view of a nozzle formed through a nozzle plate.

FIG. 8 is a sectional view of the nozzle 8. As shown in FIG. 8, on an outside surface of the nozzle plate 29, a water repellent film 30 made of, for example, Ni-PTFE (polytetrafluoroethylene) is formed. The water repellent film 30 prevents the ink from remaining the periphery of the ejecting side of the nozzle 8, by which accuracy of ink ejection operation is enhanced.

Figure 9:
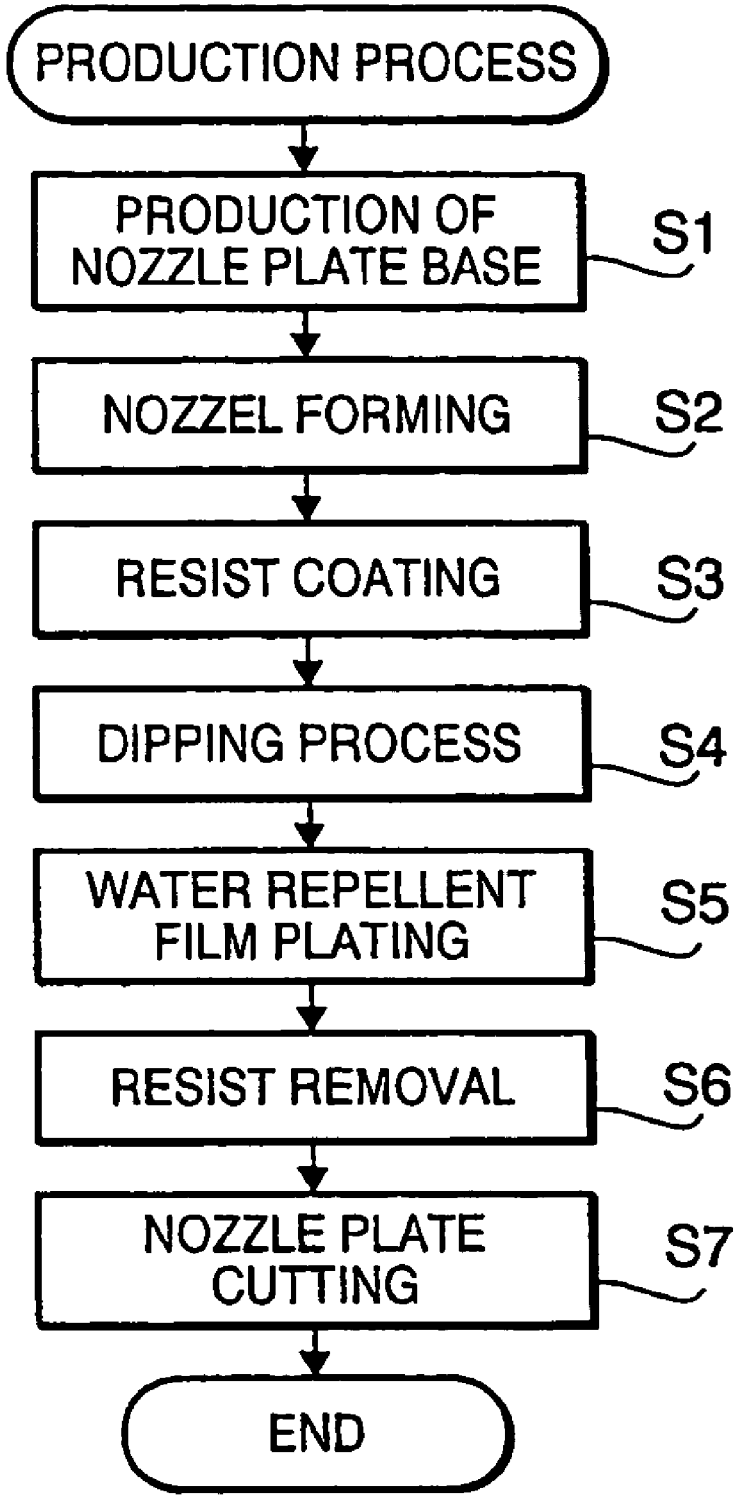
FIG. 9 shows a production process of the nozzle plate.
Figure 10:
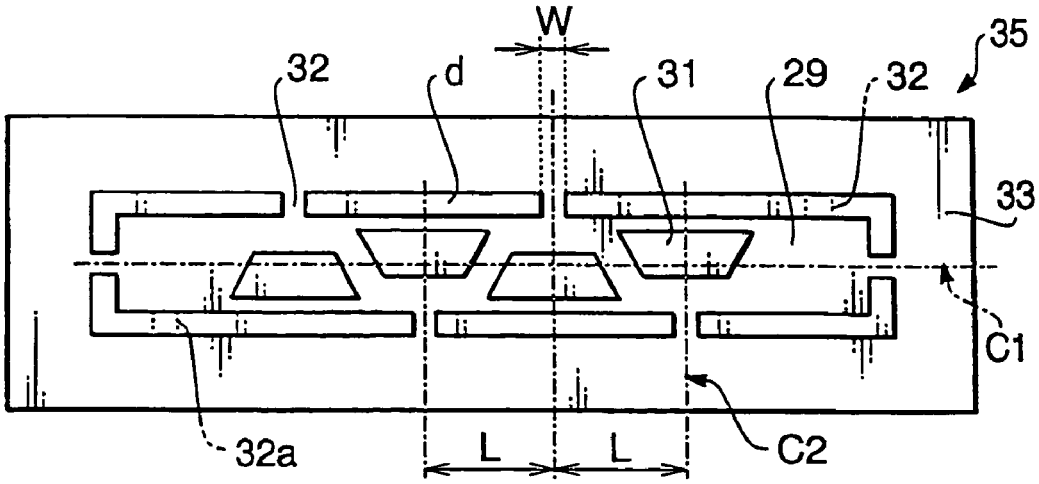
FIG. 10 is a plane view of a nozzle plate base.

FIG. 9 shows a production process of the nozzle plate 29. In a production process of a nozzle plate base (step S1), a nozzle palate base 35 (see FIG. 10) is formed. FIG. 10 is a plane view of the nozzle plate base 35. As shown in FIG. 10, the nozzle plate base 35 is formed by using a wet etching so that the nozzle plate base 35 has a single-piece structure composed of the nozzle plate 29 and an outer frame 33 which are connected to each other via a plurality of connecting portions 32. Between the outer frame 33 and the nozzle plate 29, a gap having a size d is formed.

That is, the nozzle plate base 35 is formed by making the gap d on a Ni-PTFE thin plate using the wet etching. It is noted that the nozzle plate base 35 may be formed by using a dry etching, sandblast, or stamping.

In a nozzle forming process (step S2), a plurality of nozzle group 31 each having the plurality of nozzles 8, each of which tapers toward the ejecting side thereof as shown in FIG. 8, are formed on the nozzle plate 29 by using, for example, press working. The nozzle groups 31 respectively correspond to the ejection element groups 9.

In a resist coating process (step S3), the ejecting side surface of the nozzle plate 29 is coated with a resist 37 (see FIG. 12), so that the nozzle 8 is filled with the resist 37. Consequently, it is prevented that the water repellent film adheres to an internal surface of the nozzle 8. Also, deterioration of the accuracy of the ink ejection operation can be prevented.

Figure 11:
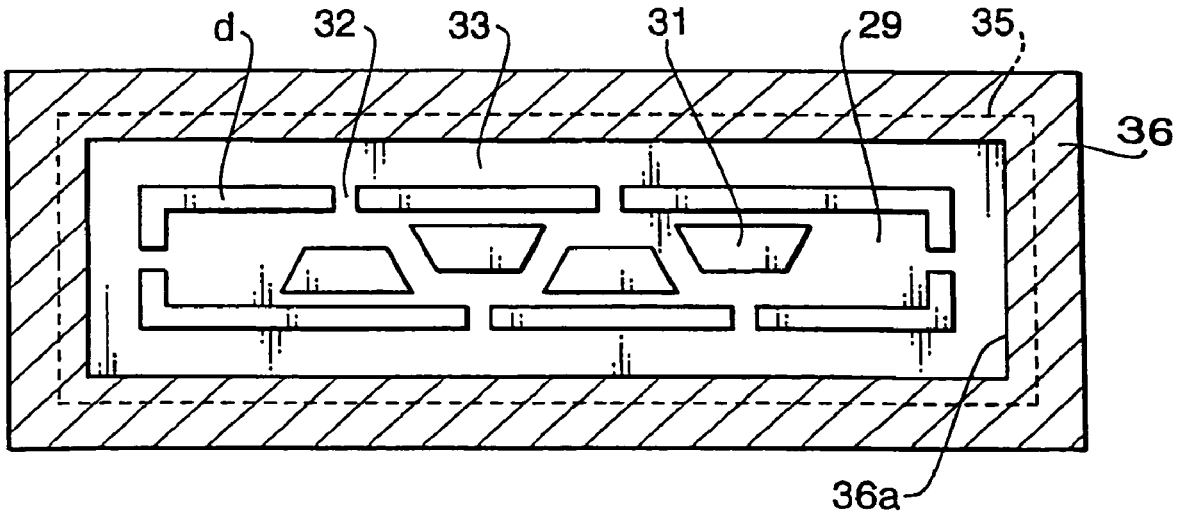
FIG. 11 is a plan view of the nozzle plate base when the nozzle plate base is attached to an electrode.
Figure 12:
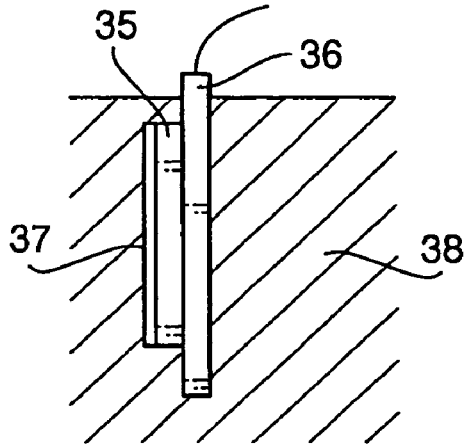
FIG. 12 shows a situation where the nozzle plate base is dipped into an electrolytic solution.

In an electrolytic solution dipping process (step S4), the nozzle plate 29 is attached to an electrode 36 at a peripheral portion of the outer frame 33, as shown in FIG. 11. The electrode 36 is made of, for example, Cu or Ag, and has an opening 36*a*. Then, as shown in FIG. 12, the nozzle plate base 35 and the electrode 36 are dipped into an electrolytic solution 38.

Next, in a water repellent film coating process (step S5), a voltage is applied to the electrode 36 dipped into the electrolytic solution 38. By the application of the voltage to the electrode 36, a current supplied from the electrode 36 via the connecting portions 32 flows through the surface of the nozzle plate 29 uniformly. Performing the coating process (step S5) by a current density raging from 1 through 5 amperes per square centimeters (1~5A/cm$^2$) for a few minutes, the water repellent film 30, made of Ni-PTFE, having the thickness ranging from 1 through 5 micrometers can be formed on the ejecting side surface of the nozzle plate 29.

To deposit PTFE on the nozzle plate 29 more uniformly, it is preferable that stirring the electrolytic solution 38 or swaying an object to be plated (i.e., the nozzle plate 29) in the electrolytic solution 38 is performed.

In a resist removal process (step S6), the resist 37 filled in the nozzle 8 is removed. In a nozzle plate cutting process (step S7), the nozzle plate 29 is cut off from the outer frame 33 by using, for example, a press working. Consequently, the nozzle plate 29 having with the water repellent film is provided.

As described above, the nozzle plate 29 is supplied with the voltage from the outer frame 33 via the connecting portion 32. This configuration of the nozzle plate 29 enables the voltage distribution on the nozzle plate to become uniform as indicated below in detail. As a result, the thickness of the water repellent film on the nozzle plate 29 becomes uniform.

Figure 13:
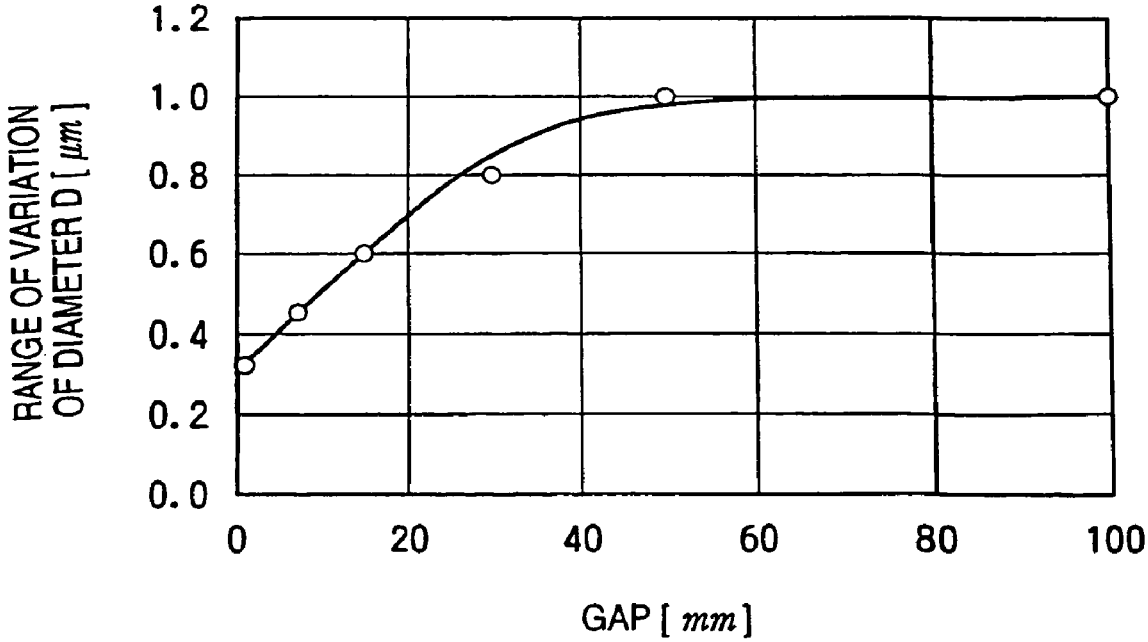
FIG. 13 is a graph showing a relationship between a range of variation of a diameter D of an orifice of the nozzle and the size of a gap.

Table 1 shows a relationship between the range of variation (micrometer) of a diameter D (see FIG. 8) of the orifice of the nozzle 8 and the size (mm) of the gap d. Also, FIG. 13 is a graph showing the relationship between the range of variation (micrometer) of the diameter D (see FIG. 8) of the orifice of the nozzle 8 and the size (mm) of the gap d.

TABLE 1

| GAP d (mm) | 1 | 7 | 15 | 30 | 50 | 100 |
|---|---|---|---|---|---|---|
| RANGE OF VARIATION OF DIAMETER D (μm) | 0.32 | 0.45 | 0.6 | 0.8 | 1 | 1 |

The current flowing through the nozzle plate 29 tends to concentrate at the peripheral portion of the nozzle plate 29. If the gap d is short, the current from the nozzle plate 29 to the outer frame 33 flows more easily via the connecting portions 32, by which the concentration of the current flow at the peripheral portion of the nozzle plate 29 can be reduced. Such a tendency is also seen from FIG. 13. As shown in FIG. 13, the thickness of the water repellent film on the nozzle plate 29 is uniformed and therefore the range of variation of the diameter D of the nozzle 8 reduces as the gap d reduces.

In general, when the range of variation of the diameter D gets larger than 0.5 micrometer, the quality of the image formed by the inkjet head 1 reduces to a level that a user visually recognizes the deterioration of the quality of the image. As can be seen from Table 1 and FIG. 13, when the gap d is set to smaller than or equal to 10 mm, the range of variation of the diameter D can be reduced to smaller than or equal to 0.5 micrometer. Incidentally, when the gap d is set to larger than or equal to 0.5 mm, the etching process or cutting process of the nozzle plate 29 can be performed relatively easily.

Each connecting portion 32 may have a width w (see FIG. 10) substantially equal to the size of gap d. For example, the width w is 1.5 mm when the size of gap d is 1 mm.

Figure 15:
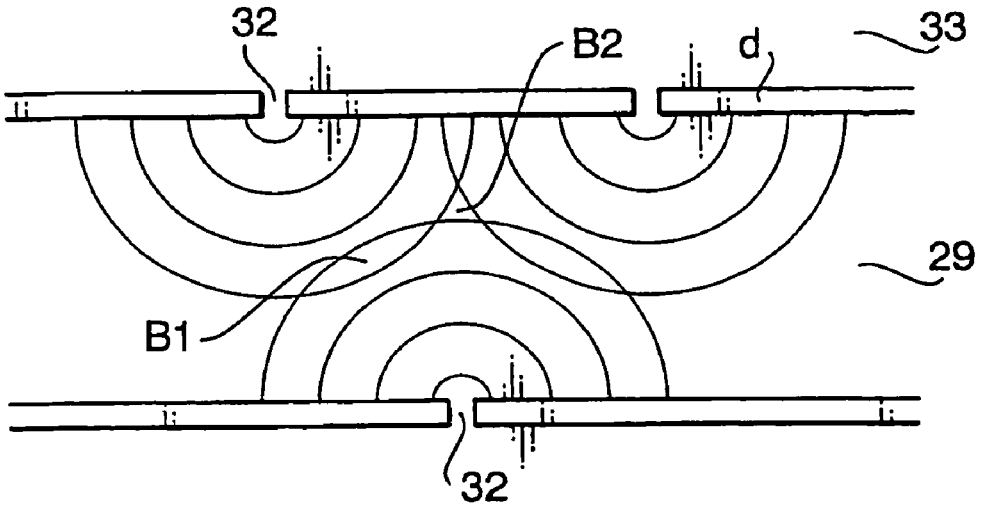
FIG. 15 shows semicircular lines, each representing positions equidistant from a corresponding connecting portion of the nozzle plate base according to the embodiment.

In FIG. 15, semicircular lines, each representing positions equidistant from the corresponding connecting portion 32 of the nozzle plate base 35 according to the embodiment, are illustrated. As shown in FIG. 15, the connecting portions 32 are arranged such that each connecting portion 32 arranged along one of the longer sides of the nozzle plate 29 is not opposed to each connecting portion 32 arranged along the other of the longer sides.

Figure 14:
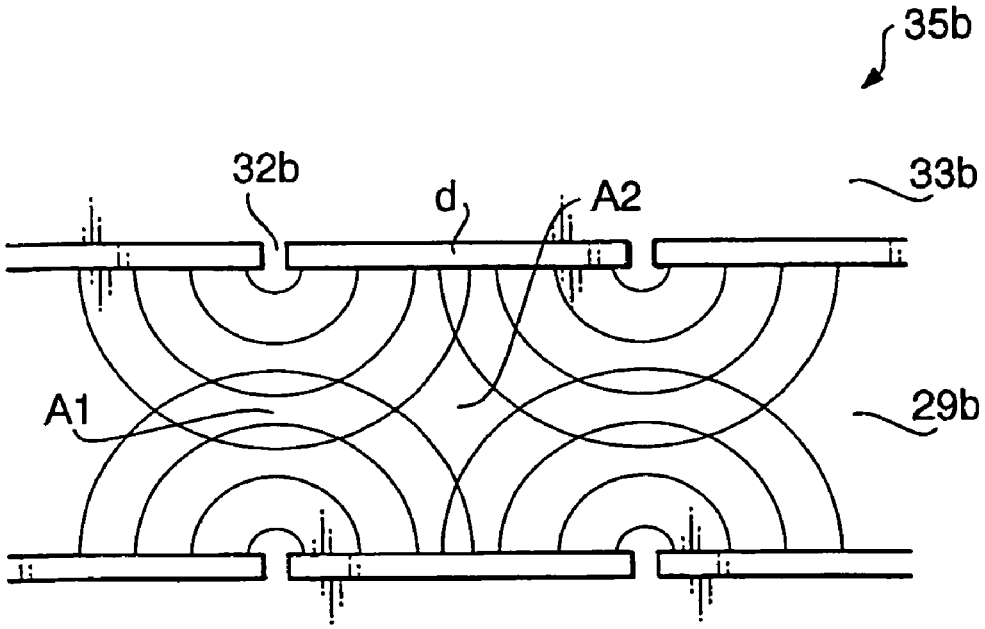
FIG. 14 shows a comparative example of a nozzle plate base to be compared with a configuration of the nozzle plate according to the embodiment.

FIG. 14 shows a comparative example of a nozzle plate base 35*b* to be compared with the configuration of the nozzle plate 29 according to the embodiment. FIG. 14 shows semicircular lines, each representing positions equidistant from a corresponding connecting portion 32*b* of the nozzle plate base 35*b*, when a nozzle plate 29*a* is configured such that connecting portions 32*b* arranged along one of longer sides of the nozzle plate 29*b* is respectively opposed to connecting portions 32*b* arranged along the other of the longer sides.

In FIG. 14, a point A1 is near to both of a pair of connecting portions 32*b* being opposed to each other, and a point A2 is relatively far from the pair of connecting portions 32*b*. Since the point A1 is supplied with the voltage by both of the pair of connecting portions 32*a*, the thickness of the plating becomes larger at the posit A1 than the thickness at the point A2. In addition, a distance between the point A1 and the point A2 is relatively large. Consequently, variation in thickness of the plating becomes relatively large in the case of the configuration shown in FIG. 14.

By contrast, in the case of FIG. 15, the distance between a point B1, at which the thickness of the plating becomes thicker, and a point B1, at which the thickness of the plating becomes thinner, becomes relatively short in comparison with the distance between the point A1 and the point A2 of FIG. 14. Consequently, variation of distribution of the current flow on the nozzle plate 29 is reduced, and thereby variation in thickness of the plating becomes smaller in the case of the configuration shown in FIG. 15 than that in the case of FIG. 14.

In addition, as shown in FIG. 10, the nozzle plate 29 is configured such that the adjacent ones of the nozzle groups 31 are shifted, in directions opposite to each other, by the same distance with respect to the center line C1 of the shorter side of the nozzle plate 29. Therefore, it becomes possible to set a distance between each connecting portion 32, which serves as a feeding point, and each nozzle group 9, which are opposed to each other, relatively large. Consequently, the current flow is sufficiently diffused in the vicinity of the nozzle group 9, by which the thickness of the plating in the vicinity of the nozzle group 29 is uniformed.

It is also noted that the distances from the connecting portions 32 to the respective nozzle groups 9 are the same. Therefore, uniformity of the thickness of the plating in the vicinity of the nozzle groups 9 can be further enhanced.

As shown in FIG. 9, each connecting portion 32 is located on a center line C2 of each nozzle group 9. Further, an interval between adjacent connecting portions 32 is set to two times as large as an interval L between adjacent nozzle group 9. With this structure, both sides of the center line C2 of each nozzle group 9 are applied with the voltage from the corresponding connecting portion 32 in the same condition. Consequently, uniformity of the thickness of the plating in the vicinity of the nozzle group 9 is enhanced.

In this embodiment, the entire circumferential region of the outer frame 33 of the nozzle plate base 35 is electrically connected to the electrode 36. In addition, the electrode 36 is made of a material having excellent electrical conductivity such as Cu or Ag. Therefore, the voltage is supplied from the electrode 36 to the outer frame 33 without a voltage drop, and all of the connecting portions 32 can be set at the same potential. Consequently, the same voltage is supplied from the connecting portions 32 to the nozzle plate 29, and thereby the uniformity of the thickness of the plating is further enhanced.

In this embodiment, the outer frame 33, the connecting portions 32 and the nozzle plate 29 are made of the same material such as Cu or Ag. This structure of the nozzle plate base 35 is advantageous in that man-hours needed to produce the nozzle plate base 35 can be reduced in comparison with a case where the nozzle plate 29 is made of two or more materials.

Although the present invention has been described in considerable detail with reference to certain preferred embodiments thereof, other embodiments are possible.

For example, alternative to the structure of the nozzle plate base 35 shown in FIG. 10, each connecting portion 32 may consist of a plurality of relatively small separate parts arranged adjacent to and/or symmetrically with respect to the center line C2.

Although in the above mentioned embodiment four connecting portions 32 are provided as shown in FIG. 10, connecting portion 32*a* (see FIG. 10) may additionally be provided for the nozzle plate base 35. As shown in FIG. 10, the connecting portions 32*a* are the distance L (the distance between adjacent nozzle groups 9) away from their respective nozzle groups 31 located nearest to the shorter sides of the nozzle plate 29. Each connecting portion 32*a* is located, with respect to the center line C1, on the same side as that on which the corresponding nozzle group 31 is located with respect to the center line C1.

By the addition of the connecting portions 32*a*, an electrical condition in which each nozzle groups 31 is supplied with electricity from its corresponding connecting portions, is further improved. As a result, the uniformity of the thickness of the plating on the nozzle plate 29 is further enhanced.

In the above mentioned embodiment, the electrode 36, the outer frame 33, the connecting portions 32 and the nozzle plate 29 are made of the same single material such as Cu or Ag. However, the nozzle plate 29 may be made of different materials, because, according to the embodiment, the same voltage can be supplied from the connecting portions 32 to the nozzle plate 29 even if the material of the nozzle plate 29 is different from that of the electrode 32, the outer frame 33 and the connecting portions 32.

The present disclosure relates to the subject matter contained in Japanese Patent Application No. 2003-188996, filed on Jun. 30, 2003, which is expressly incorporated herein by reference in its entirety.

What is claimed is:

1. A method for producing a nozzle plate of an inkjet head having a plurality of nozzles for ejecting ink, comprising the steps of:

preparing a nozzle plate base which has an electrical conductivity, the nozzle plate base including a nozzle plate, an outer frame surrounding the nozzle plate, and a plurality of connecting portions which connect the nozzle plate to the outer frame;

forming the plurality of nozzles through the nozzle plate;

dipping the nozzle plate base into an electrolytic solution; and energizing the outer frame of the nozzle plate base to plate the nozzle plate with a water repellent film, wherein a gap formed between the nozzle plate and the outer frame is smaller than or equal to 10 mm, wherein the nozzle plate has a rectangular form, wherein the nozzle plate has a plurality of nozzle groups, each of which has a plurality of nozzles arranged in a matrix, the plurality of nozzle groups being arranged in parallel with a longitudinal side of the rectangular form of the nozzle plate at predetermined intervals, wherein adjacent ones of the plurality of nozzle groups are shifted, in directions opposite to each other, by the same distance with respect to a center line of a shorter side of the nozzle plate, and wherein the plurality of connecting portions are arranged alone both of longitudinal sides of the nozzle plate, each of the connecting portions arranged along one of the longitudinal sides of the nozzle plate being opposed to each of the nozzle groups shifted to the other of the longitudinal sides of the nozzle plate with respect to the center line of the shorter side of the nozzle plate.

2. The method according to claim 1, wherein a distance between adjacent ones of the connecting portions arranged along one of the longitudinal sides of the nozzle plate is twice as long as the predetermined interval of the plurality of nozzle groups, wherein each of the connecting portions is located on a center line of a corresponding one of the nozzle groups located oppositely thereto, the center line passing through a center of the corresponding one of the nozzle groups in the longitudinal direction, the center line being parallel with the shorter side of the nozzle plate.

3. The method according to claim 2, wherein the plurality of connecting portion includes a first additional connecting portion and a second additional connecting portion, wherein when one of the shorter sides of the nozzle plate is defined as a first shorter side, and the other of the shorter sides of the nozzle plate is defined as a second shorter side, the first additional connecting portion is located at a position shifted to the first shorter side by one predetermined interval of the plurality of nozzle groups from one of the nozzle groups located nearest to the first shorter side, the first additional connecting portion being located on the same longitudinal side as that to which the one of the nozzle groups located newest to the first shorter side is shifted with respect to the center line of the shorter side, wherein the second additional connecting portion is located at a position shifted to the second shorter side by one predetermined interval of the plurality of nozzle groups from one of the nozzle groups located nearest to the second shorter side, the second additional connecting portion being located on the same longitudinal side as that to which the one of the nozzle groups located nearest to the second shorter side is shifted with respect to the center line of the shorter side.

4. A nozzle plate having a rectangular form used for an inkjet head, comprising:

a plurality of nozzle groups arranged in parallel with a longitudinal side of the nozzle plate at predetermined intervals, each of the nozzle groups having a plurality of nozzles arranged in a matrix; and a plurality of connecting portions through which voltage is applied to the nozzle plate when the nozzle plate is subjected to plating of a water repellent film, wherein the plurality of connecting portions are arranged along both of longitudinal sides of the nozzle plate, each of the connecting portions arranged along one of the longitudinal sides of the nozzle plate being not opposed to each of the connecting portions arranged along the other longitudinal side of the nozzle plate, and wherein a distance between adjacent ones of the connecting portions arranged alone one of the longitudinal sides of the nozzle plate is twice as lone as the predetermined interval of the plurality of nozzle groups.

5. The nozzle plate according to claim 4, wherein each of the connecting portions is located on a center line of a corresponding one of the nozzle groups located oppositely thereto, the center line passing through a center of the corresponding one of the nozzle groups in the longitudinal direction, the center line being parallel with the shorter side of the nozzle plate.

6. The nozzle plate according to claim 5, wherein the plurality of connecting portion includes a first additional connecting portion and a second additional connecting portion, wherein when one of the shorter sides of the nozzle plate is defined as a first shorter side, and the other of the shorter sides of the nozzle plate is defined as a second shorter side, the first additional connecting portion is located at a position shifted to the first shorter side by one predetermined interval of the plurality of nozzle groups from one of the nozzle groups located nearest to the first shorter side, the first additional connecting portion being located on the same longitudinal side as that to which the one of the nozzle groups located nearest to the first shorter side is shifted with respect to the center line of the shorter side, wherein the second additional connecting portion is located at a position shifted to the second shorter side by one predetermined interval of the plurality of nozzle groups from one of the nozzle groups located nearest to the second shorter side, the second additional connecting portion being located on the same longitudinal side as that to which the one of the nozzle groups located nearest to the second shorter side is shifted with respect to the center line of the shorter side.

7. A nozzle plate having a rectangular form used for an inkjet head, comprising:

a plurality of nozzle groups arranged in parallel with a longitudinal side of the nozzle plate at predetermined intervals, each of the nozzle groups having a plurality of nozzles arranged in a matrix; and a plurality of connecting portions through which voltage is applied to the nozzle plate when the nozzle plate is subjected to plating of a water repellent film, wherein the plurality of connecting portions are arranged along both of longitudinal sides of the nozzle plate, each of the connecting portions arranged along one of the longitudinal sides of the nozzle plate being not opposed to each of the connecting portions arranged along the other longitudinal side of the nozzle plate, wherein adjacent ones of the plurality of nozzle groups are shifted, in directions opposite to each other, by the same distance with respect to a center line of a shorter side of the nozzle plate, and wherein the plurality of connecting portions are arranged along both of longitudinal sides of the nozzle plate, each of the connecting portions arranged along one of the longitudinal sides of the nozzle plate being opposed to each of the nozzle groups shifted to the other of the longitudinal sides of the nozzle plate with respect to the center line of the shorter side of the nozzle plate.

8. The nozzle plate according to claim 7, wherein each of the plurality of nozzle groups has a trapezoidal form, wherein a distance between a long side of the trapezoidal form of each nozzle group and the longitudinal side to which the each nozzle group is shifted is shorter than a distance between a short side of the trapezoidal form of the each nozzle group and the longitudinal side to which the each nozzle group is shifted.

9. A nozzle plate base to be subjected to plating process, comprising:

an outer frame;

a nozzle plate; and a plurality of connecting portions which electrically connects the nozzle plate to the outer frame, wherein the nozzle plate includes:

a plurality of nozzle groups arranged in parallel with a longitudinal side of the nozzle plate at predetermined intervals, each of the nozzle groups having a plurality of nozzles arranged in a matrix;

wherein the plurality of connecting portions are arranged along both of longitudinal sides of the nozzle plate, each of the connecting portions arranged along one of the longitudinal sides of the nozzle plate is not opposed to each of the connecting portions arranged along the other longitudinal side of the nozzle plate, and wherein the outer frame has two longitudinal sides respectively located outside two longitudinal sides of the nozzle plate with gaps between each longitudinal side of the outer frame and a respective longitudinal side of the nozzle plate, wherein the gaps and the outer frame are in a same plan view.

10. The nozzle plate base according to claim 9, wherein said nozzle plate base has a single-piece structure and is made of a single material.

11. The nozzle plate base according to claim 9, wherein a gap smaller than or equal to 10 mm is formed between said nozzle plate and said outer frame.

12. A method for producing a nozzle plate of an inkjet head having a plurality of nozzles for ejecting ink, comprising the steps of:

preparing a nozzle plate base which has an electrical conductivity, the nozzle plate base including a nozzle plate, an outer frame surrounding the nozzle plate, and a plurality of connecting portions which connect the nozzle plate to the outer frame, wherein the nozzle plate includes a plurality of nozzle groups arranged in parallel with a longitudinal side of the nozzle plate at predetermined intervals, each of the nozzle groups having a plurality of nozzles arranged in a matrix; and the plurality of connecting portions are arranged along both of longitudinal sides of the nozzle plate, each of the connecting portions arranged along one of the longitudinal sides of the nozzle plate is not opposed to each of the connecting portions arranged along the other longitudinal side of the nozzle plate;

forming the plurality of nozzles through the nozzle plate;

dipping the nozzle plate base into an electrolytic solution; and energizing the outer frame of the nozzle plate base to plate the nozzle plate with a water repellent film, wherein a gap formed between the nozzle plate and the outer frame is smaller than or equal to 10 mm, wherein the gap and the outer frame are in a same plan view.

13. The method according to claim 12, further comprising the step of removing the nozzle plate from the nozzle plate base by cutting the plurality of connecting portions after the step of energizing is finished.

14. The method according to claim 12, wherein the nozzle plate has a rectangular form, wherein the plurality of connecting portions are arranged along both of longitudinal sides of the rectangular form of the nozzle plate.

15. The method according to claim 14, wherein the plurality of connecting portions are arranged such that each of the connecting portions arranged along one of the longitudinal sides of the nozzle plate is not opposed to each of the connecting portions arranged along the other longitudinal side of the nozzle plate.

16. The method according to claim 12, wherein the nozzle plate base including the outer frame, the nozzle plate and the plurality of connecting portions has a single-piece structure and is made of a single material.

17. The method according to claim 12, wherein before the step of the dipping, the nozzle plate base is attached to an electrode used to energize the nozzle plate base, the electrode contacting a peripheral portion of the outer frame on a side on which the nozzle plate is to be covered with the water repellent film, the electrode having an electrical conductivity higher than that of the nozzle plate base.

18. The method according to claim 12, further comprising the steps of:

coating the nozzle plate with a resist so that the plurality of nozzles are filled with the resist before the step of the dipping; and removing the resist from the plurality of nozzles after the step of the energizing.

19. A nozzle plate having a rectangular form used for an inkjet head, comprising:

a plurality of nozzle groups arranged in parallel with a longitudinal side of the nozzle plate at predetermined intervals, each of the nozzle groups having a plurality of nozzles arranged in a matrix: and a plurality of connecting portions through which voltage is applied to the nozzle plate when the nozzle plate is subjected to plating of a water repellent film, wherein the plurality of connecting portions are arranged along both of longitudinal sides of the nozzle plate, each of the connecting portions arranged along one of the longitudinal sides of the nozzle plate being not opposed to each of the connecting portions arranged along the other longitudinal side of the nozzle plate, and wherein the plurality of connecting portions electrically connect the nozzle plate with an outer frame, the outer frame having two longitudinal sides respectively located outside two longitudinal sides of the nozzle plate with gaps between each longitudinal side of the outer frame and a respective longitudinal side of the nozzle plate, wherein the gaps and the outer frame are in a same plan view.

* * * * *